US006347538B1

(12) United States Patent
Doiron

(10) Patent No.: US 6,347,538 B1
(45) Date of Patent: Feb. 19, 2002

(54) LOCKING MECHANISM FOR WEAPONS

(76) Inventor: Gerald J. Doiron, 867 Chestnut Ct., Marco Island, FL (US) 34145-2307

( * ) Notice: Subject to any disclaimer, the term of this patent is extended or adjusted under 35 U.S.C. 154(b) by 0 days.

(21) Appl. No.: 09/726,139

(22) Filed: Nov. 29, 2000

(51) Int. Cl.[7] ..... E05B 73/00; F16A 17/02

(52) U.S. Cl. ..... 70/58; 42/70.06; 42/70.08; 70/201; 89/142; 89/148

(58) Field of Search ..... 70/58, 201, 202; 42/70.04, 70.05, 70.06, 70.08; 89/142, 148

(56) References Cited

U.S. PATENT DOCUMENTS

| | | | | | |
|---|---|---|---|---|---|
| 1,707,538 | A | * | 4/1929 | Page | 42/70.06 X |
| 2,453,683 | A | * | 11/1948 | Caldow | |
| 3,624,947 | A | * | 12/1971 | Worrell, Sr. | 42/66 |
| 3,838,533 | A | * | 10/1974 | Ruger | 42/70.08 |
| 4,768,302 | A | * | 9/1988 | Beretta | 42/70.08 |
| 5,535,605 | A | * | 7/1996 | Werner | 70/14 |
| 5,899,102 | A | * | 5/1999 | Ling | 70/202 X |
| 6,212,812 | B1 | * | 4/2001 | Aigner | 42/70.06 |

FOREIGN PATENT DOCUMENTS

| | | | | |
|---|---|---|---|---|
| EP | 505 778 | * | 12/1992 | 42/70.06 |
| GB | 588476 | * | 11/1933 | 89/148 |
| GB | 552560 | * | 4/1943 | 89/142 |

* cited by examiner

*Primary Examiner*—Lloyd A. Gall
(74) *Attorney, Agent, or Firm*—Ronald R. Kilponen

(57) ABSTRACT

A locking mechanism is shown for locking weapons. The mechanism works with a lever that turns and locks and unlocks the weapon by interfacing with elements on the interior of the weapon. A key can be used to position a lock plunger such that the lever cannot be turned to the firing position, hence locking the weapon against unauthorized use.

4 Claims, 6 Drawing Sheets

LOCKING MECHANISM FOR WEAPONS

FIELD

The present version of this invention relates generally to the field of devices to lock weapons to prevent unauthorized use of the weapon.

BACKGROUND

This invention relates to locks for weapons, and more particularly to a device that would prevent the unauthorized firing of a weapon.

The gun industry is facing legislation to attempt to make handguns safer such that accidents don't occur. Children appear to be fascinated with handguns and many injuries occur each year due to a child finding and borrowing a handgun and not understanding the danger which is made even greater when the weapon is loaded. Even if the safety is on, this can easily be defeated hence arming the weapon.

If a child is ambitious enough to find the weapon, then the chances are they can slip the safety to the fire position without even realizing what they have done. This is especially dangerous when the weapon is loaded. Unnecessary accidents could be avoided by keeping weapons unloaded and also by having additional locking mechanisms for the weapons. If the weapon is unloaded and locked, then the curious child must find both the ammunition, know how to load the weapon, find the key and unlock the weapon to make it functional.

Many times no deterrent devices are used on the handgun and the handgun can be operated when found causing accidental injuries or can be used to commit crimes. The prior art shows many deterrent devices and there are several on the market, to deter or prevent the unauthorized operation of a weapon.

Many deterrent devices are bulky exterior ad ons to the weapon itself making them harder to holster and store. These ad ons can also affect the look of the weapon in a negative way. Some require custom work be done on the weapon, like drilling or other machine work. This thus creates a custom weapon which has questionable value to collectors. A later owner of this custom weapon may have a harder time getting a gun smith to repair or maintain this custom device. While these bulky exterior ad ons to the weapon increase cost, don't look that good, require custom work and complicate maintenance and repairs, some of them are effective in deterring unauthorized firing of the weapon.

Some deterrent devices use rings or other transmitters which must be within a certain distance of a weapon to allow the weapon to fire. These have batteries which may run down causing inconvenience at the least. In the worst case, one would not be able to be fired in the case of a life threatening emergency.

Many weapons are also stolen. These weapons can be and many times are used to commit crimes and then discarded. It would be helpful if persons who steal weapons would be discouraged from being able to operate them. Many times the deterrence devices used are easy to defeat if one has tools and the time to defeat them. The weapon will be largely unaffected by the careful removal of, for example, a trigger lock. This thus allows the weapon to be sold to another or used with relative ease, once the trigger lock is removed. While many deterrence devices can be defeated, the more difficult it is to defeat, the less likely a thief will steal that weapon instead choosing to leave the weapon in hopes of finding one that is easier to defeat.

Most weapons have a safety device where the weapon can be loaded and the safety device engaged such that the weapon cannot fire. This is accomplished by many means in the prior art, one such method is to separate the link between the trigger and the hammer. This separation can be accomplished in many ways or methods. Generally, it is done by physically moving this link between the trigger and the hammer such that pulling the trigger does not engage the hammer. When the safety device is not engaged, the link between the trigger and hammer is active and the weapon can be fired. Other safety devices use various pins or bars to prevent the operation of components within the hand gun impeding the ability to fire the weapon. There are many ways to prevent a handgun from firing with mechanical components and the preferred method depends largely on the design of the handgun itself and creativity of the engineering staff.

Many weapons utilize a lever as a safety device. Disengaging the trigger from the hammer involves rotating the lever such that the lever moves the link and the trigger and hammer are not engaged. Rotating the lever again allows the link to engage the trigger and the hammer thereby arming the weapon. The lever could also be used to prevent movement of other elements or separate other elements which would also prevent the handgun from firing.

One disadvantage with the lever safety method is that anyone authorized or unauthorized can disengage the safety device. If one finds a loaded weapon, it is likely that they will be able to disengage the lever safety device making the weapon operable. It would be convenient if a locking mechanism were available that could fix the lever safety device such that when the trigger and hammer are disengaged or the weapon is locked, the weapon cannot be made operable without the authorized user of the weapon.

It would also be beneficial if this locking mechanism did not affect the profile of the weapon with a bulky exterior ad on to the weapon but would be internally contained and interact with components on the interior of the weapon. This locking mechanism should not change the look of the weapon so that the weapon is still desirable to collectors. This locking mechanism should be difficult to defeat so that it could not be used immediately after it is found or stolen.

It would be beneficial if this locking mechanism would use the existing safety device or be designed such that the locking mechanism could be made from the existing safety device components with minimal modifications and contained primarily within the interior of the weapon. This is beneficial from both the aesthetics standpoint and the manufacturer's cost standpoint.

For the foregoing reasons, there is a need for a locking mechanism for handguns.

SUMMARY

In view of the foregoing disadvantages inherent in the prior art for locking weapons, there is a need for a locking device that is effective, does not negatively effect the look of the weapon, does not require custom work on the weapon, is not a bulky exterior ad on to the weapon, and can easily be incorporated into the design of the weapon by the manufacturer.

A first object of the invention is to provide a device that is effective in locking a weapon to the unauthorized user.

Another object of the invention is to provide a device that is aesthetically appealing and does not wreck the profile of the weapon to collectors.

It is yet another object of the invention to provide a device that does not require unappealing major custom work to the weapon to install the device.

It is a still further object of the invention to provide a device that can be easily incorporated into the existing design of the weapon by the manufacturers and be contained primarily within the weapon.

These together with other objects of this invention, along with various features of novelty which characterize this invention, are pointed out with particularity in the claims annexed hereto and forming a part of this disclosure. For a better understanding of this invention, its operating advantages and the specific objects attained by its uses, reference should be had to the accompanying drawings and descriptive matter in which there is illustrated a preferred embodiment of this version of the invention.

DETAILED DESCRIPTION OF THE PREFERRED EMBODIMENTS

Figure 1:
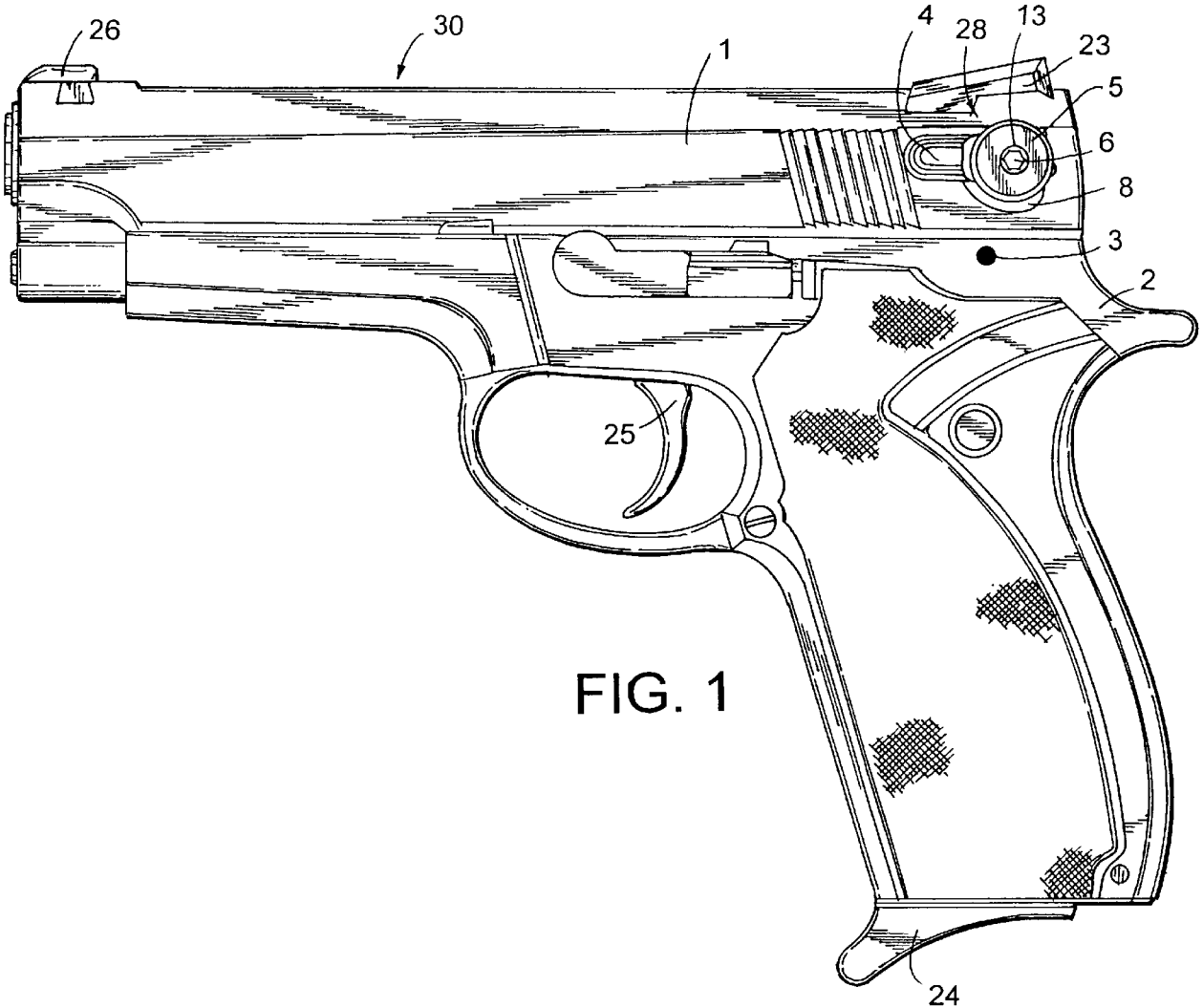
FIG. 1 shows a side view of a weapon having a locking mechanism, the weapon commonly known in the art.

Referring to the drawings in detail wherein like elements are indicated by like numerals, there is shown in FIG. 1 one embodiment of the locking mechanism 28 on a handgun 30. The locking mechanism 28 modifies the typical "safety" lever 4, well know in the art. While the embodiments shown in the figures, shows the locking mechanism 28 on the left hand side of the handgun 30 when viewed from the rear, this device would work just as well and can be used on the right hand side of the handgun 30.

The typical device on handguns is a safety lever 4 that interacts with various components of the handgun to prevent the handgun 30 from firing. This can be accomplished by many different methods, the most typical being the separation of the link interconnecting the trigger 25 and the hammer (not shown), thus preventing the handgun from firing. Other methods can be used to prevent the handgun 30 from firing while using the safety lever 4. The safety lever 4 can be used to lock or separate many other components of the handgun 30 and this device is not meant to be limited to use with any particular method of locking the handgun 30.

When the safety lever 4 is in the fire position, FIG. 1, the components are in an operational position and the handgun 30 will fire. When the safety lever 4 is in the no-fire position, FIGS. 3,4,5, the handgun 30 will not fire. The method for putting the weapon in the no-fire position generally involves separating the trigger 25 and hammer to prevent operation of the firing mechanism. Other methods are used to put a weapon in the no-fire position and this locking mechanism 28 could be utilized on weapons using those other methods.

Figure 6:
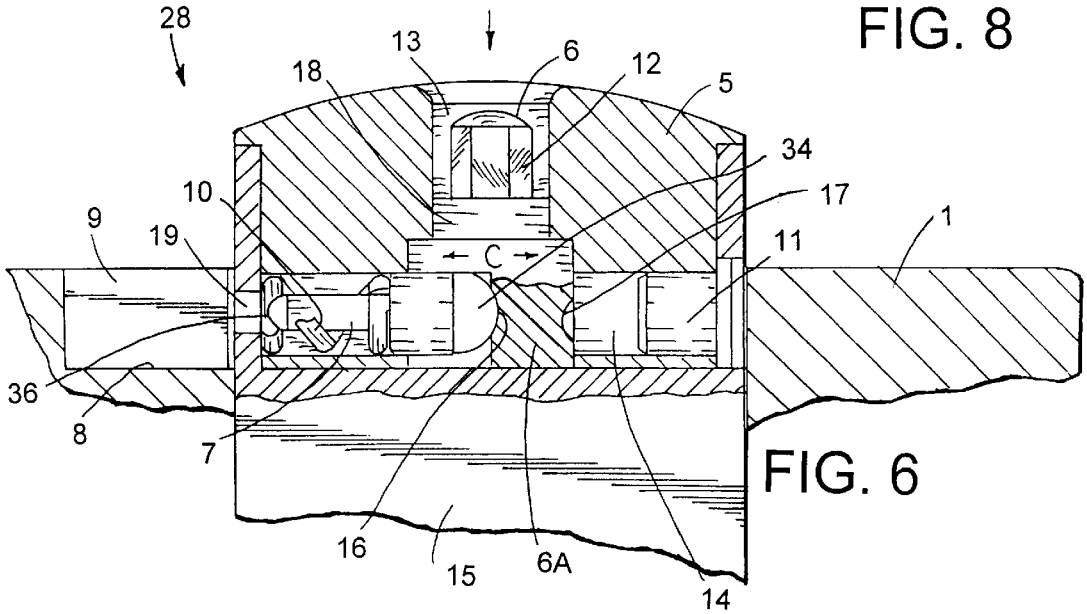
FIG. 6 shows one embodiment of a bottom partial cutaway view of the lock mechanism and the cam lobe in the open position.

FIG. 1 shows the locking mechanism 28 having a safety lever 4 and a lock insert 5 with a centrally located lock shaft 6. FIG. 6 shows a partial cutaway view from the bottom of the locking mechanism 28. It should be noted that none of the elements of the locking mechanism extend beyond the weapon surface, in other words, the elements of the locking mechanism 28 are internal to the firearm 30.

The lock insert 5 houses the rotation pin 18 which has a cam lobe 6A. The rotation pin 18 is centrally located and rotatable within the lock insert 5. The cam lobe 6A has a first radius dimple 16 and second radius dimple 17 located approximately 180 degrees apart on cam lobe 6A at the lower section of the rotation pin 18.

While this embodiment shows a first radius dimple 16 and second radius dimple 17 for engaging the lock plunger 7, the same function could be accomplished with stops and sliders (not shown) or a means for moving the lock plunger. While this may limit the direction the key 32 could be turned in locking and unlocking the weapon, the same function would be accomplished. This same function could also be accomplished with the use of a linkage device (not shown) which, when the rotation pin 18 was rotated, the linkage would drive or release the lock plunger 7 depending on the angular location.

FIG. 6 shows one embodiment of the rotation pin 18, another embodiment could have a longer rotation pin 18. This would result in the components of the locking mechanism 28 being located further interior of the weapon (not shown).

Figure 5:
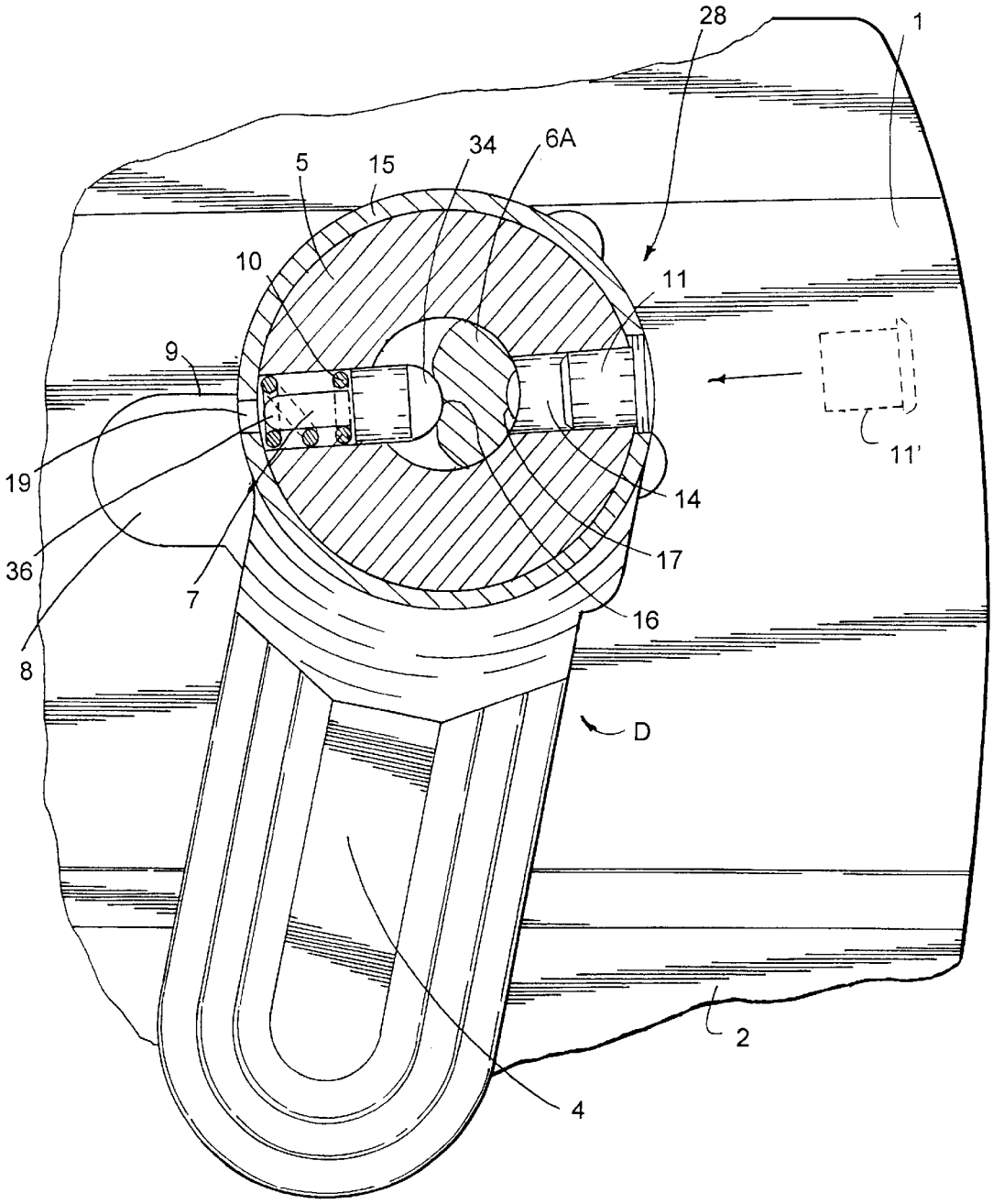
FIG. 5 shows one embodiment of a detailed partial cutaway view of the locking mechanism in the no-fire or locked position with the cam lobe in the open position.
Figure 7:
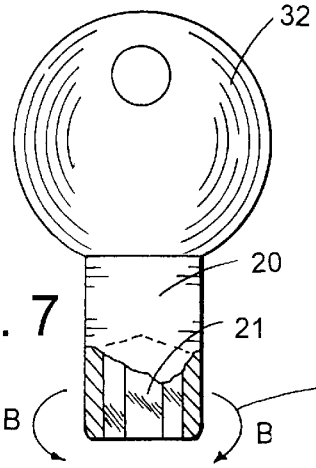
FIG. 7 shows a side view of the key for locking and unlocking the locking mechanism.
Figure 8:
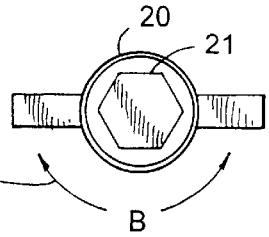
FIG. 8 shows another view of a key.

FIG. 5 shows a portion of the cam lobe 6A removed adjacent the first radius dimple 16, creating a slot like excavation for the lock plunger 7. This removed material and the first radius dimple 16 allows the lock plunger 7 return spring 10, to bias the lock plunger 7 to a first position such that the lock plunger 7 is contained within the lock insert 5, FIG. 5. This enables the safety lever 4 and safety shaft 15 to rotate relative to the lock insert 5.

FIG. 6 shows a lock shaft 6 on the end opposite the cam lobe 6A of the rotation pin 18. The lock shaft 6 extends to near the outer surface of the lock insert 5, FIG. 6. While this embodiment shows the lock shaft 6 termination near the outer surface of lock insert 5, other embodiments could have a shorter lock shaft 6. This would require a longer shaft on key 32, but the function would remain the same. A shorter lock shaft 6 may enhance the difficulty in defeating the locking mechanism 28.

A circumferential hole 13 in the lock insert 5 is cut around the lock shaft 6. The hole 13 is just larger than the key diameter 20 which allows the female hex insert 21 of the key 32 to engage the corresponding hex pattern 12 of the lock shaft 5. Once the key 32 engages the rotation pin 18, the rotation pin 18 can be rotated. The lock shaft 6 could be shorter or longer relative to the lock insert 5. The hole 13 could be machined in various shapes and configurations as long as the key 32 engages the lock shaft 6 and matches the hole 13.

The hole 13 is just larger than the key diameter 20 such that there is a minimal amount of clearance around the lock shaft 6. This discourages the jamming of a tool or other device to turn rotation pin 18. This discourages the operation of the handgun 30 by unauthorized person or anyone who does not have the key 32.

FIG. 6 shows the safety shaft 15 which extends into the slide 1 and interior of the hand gun 30 to engage the components which are used to lock and unlock the weapon. The safety shaft 15 has a larger diameter lock through hole 14 extending through one side wall and a smaller diameter housing hole 19 through the opposite side wall. The lock through hole 14 is sealed with a locking pin 11 or keeper, FIG. 6. The locking pin 11 or keeper, aligns and holds the components together in addition to preventing access to the lock through hole 14 and other components.

The housing hole 19 is for allowing the lock plunger 7 to extend through housing hole 19 of the safety shaft 15 to a second position. When the second end 36 of the lock plunger 7 extends through housing hole 19 to the second position, the safety lever 4 and safety shaft 15 cannot be rotated to put the handgun 30 in the operating position. As the operator attempts to rotate the safety lever 4 and safety shaft 15, the lock plunger 7 abuts the slide stop surface 9, FIGS. 4 & 6 and no rotation is permitted.

To unlock the handgun 30 so that it will fire, requires that the key 32 be inserted over the lock shaft 6 of the rotation pin 18. The operator would then rotate the key 32 about 180 degrees such that the rotation pin 18 rotates within the lock insert 5. While this embodiment shows the first radius dimple 16 and the second radius dimple 17 approximately 180 degrees apart other angular configurations would be acceptable.

The lock plunger 7 has a larger diameter first end 34 opposite a smaller diameter second end 36. The larger diameter first end 34 contacts the cam lobe 6A as the rotation pin 18 rotates from a locked position, FIG. 4, to the unlocked position FIG. 5. As the rotation pin 18 rotates within the lock insert 5, the first end 34 moves from within the second radius dimple 17 and rides along the outer surface of the cam lobe 6A. This allows the return spring 10 to bias the lock plunger 7 second end 36 to a position within the lock insert 5. The second end 36 becomes housed completely within the lock insert 5 when the first end 34 rests in the first radius dimple 16, FIGS. 5 & 6.

Figure 2:
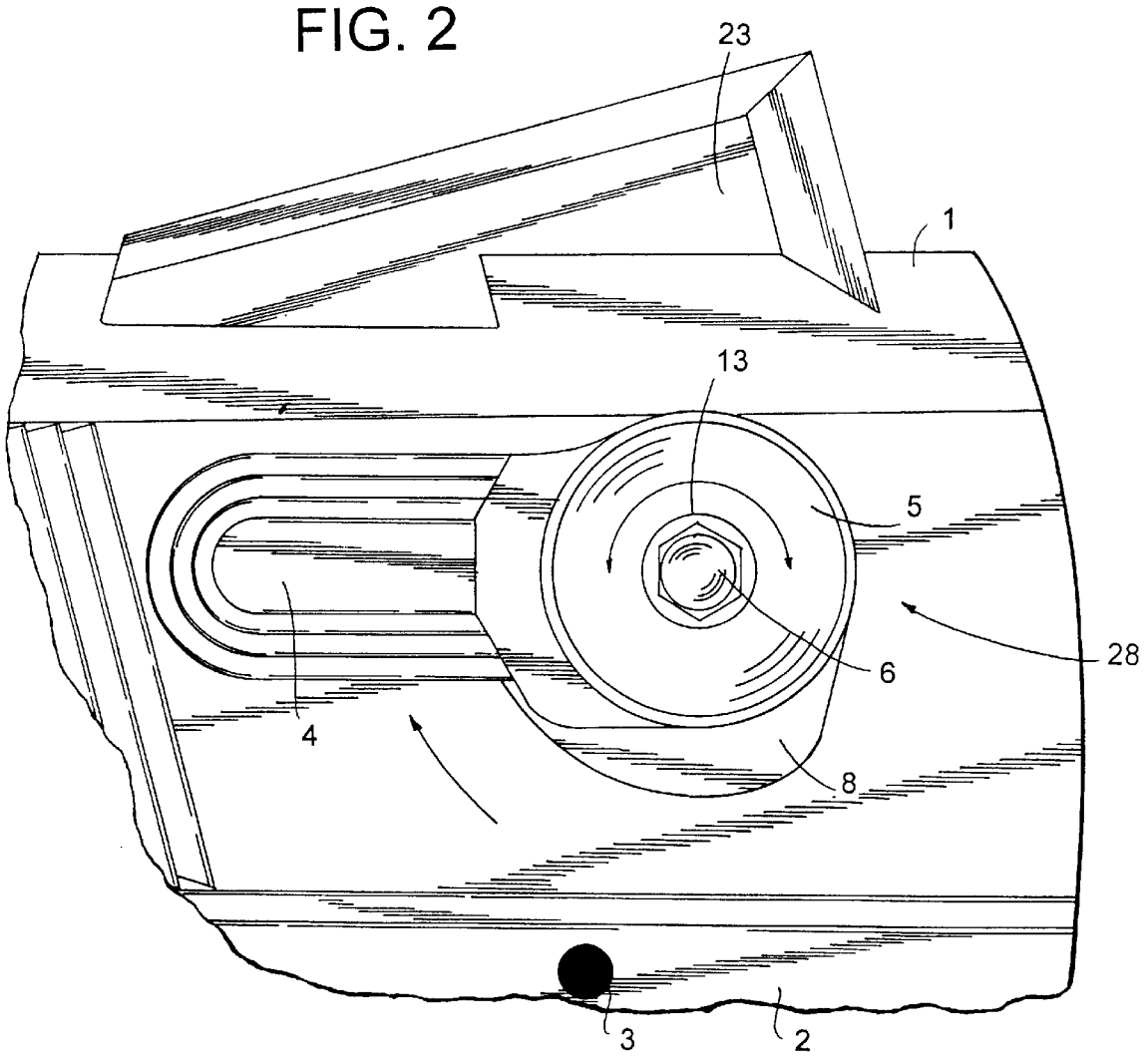
FIG. 2 shows a detailed view of one embodiment the locking mechanism in the fire position.
Figure 3:
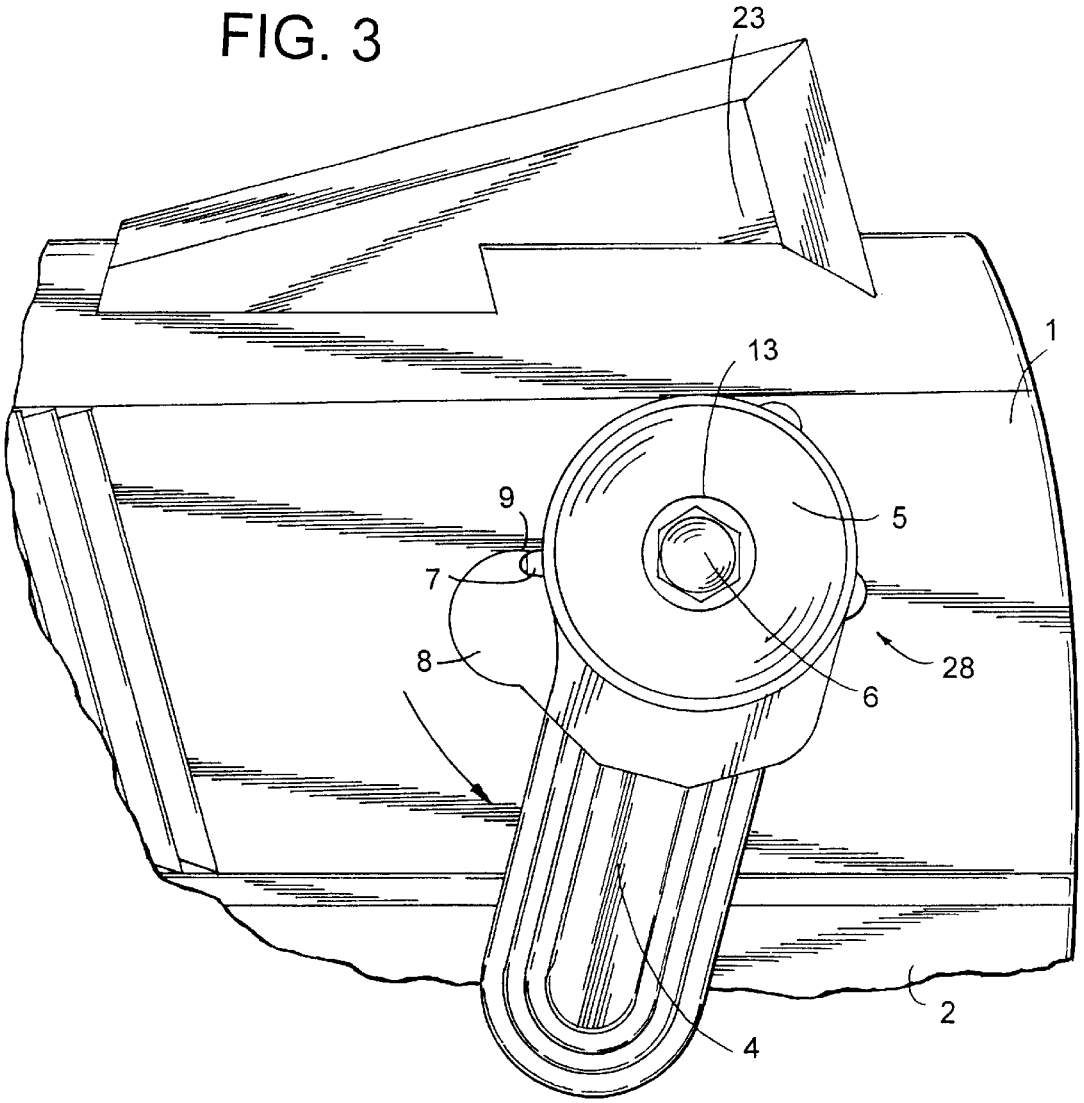
FIG. 3 shows a detailed view of one embodiment of the locking mechanism in the no-fire or locked position.

When the lock plunger 7 is housed within the lock insert 5, the safety lever 4 can be rotated from the locked position shown in FIG. 3 to the unlocked position shown in FIG. 2 in which the indicator 3 is exposed showing that the weapon is operational. The key 32 is then removed and stored.

To lock the weapon, the user would rotate the safety lever 4 of the locking mechanism 28 from the position shown in FIG. 2 to that of FIG. 3. The user would then insert the key 32 into the hole 13 engaging the female hex insert 21 with the hex pattern 12 of the lock shaft 6 of the rotation pin 18. The key 32 is then turned causing the rotation pin 18 to rotate within the safety shaft 5. This results in the first end 34 of the lock plunger 7 to disengage from the first radius dimple 16 and ride along the cam lobe 6A such that the first end 34 engages the second radius dimple 17 of the cam lobe 6A. This forces the second end 36 of the lock plunger 7 through the housing hole 19 and into the slide cavity 8 of the slide 1. With the second end 36 of the lock plunger 7 in the slide cavity 8, the safety lever 4 cannot be rotated as the second end 36 abuts the slide stop surface 9 when the safety lever 4 is turned.

Figure 4:
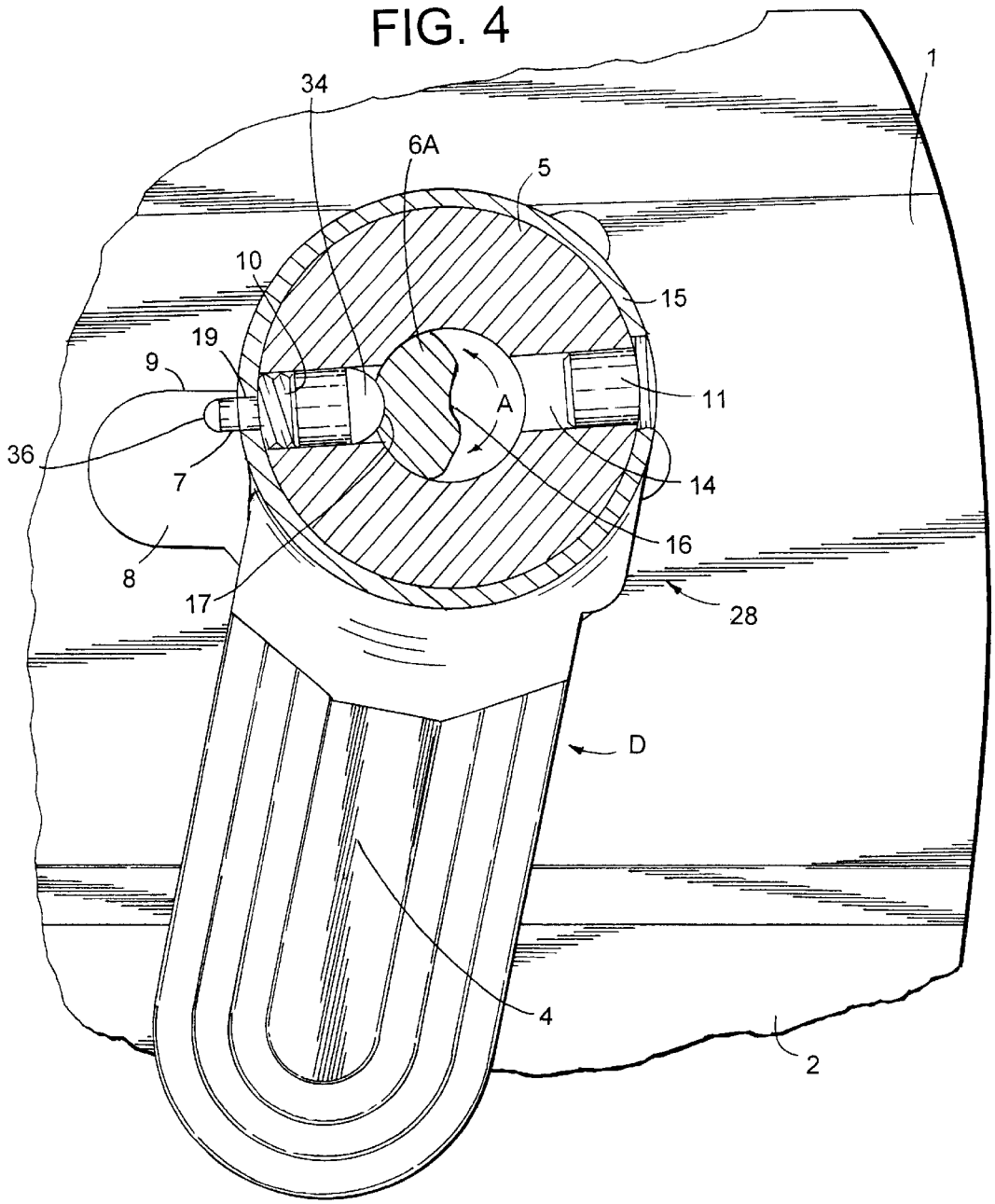
FIG. 4 shows one embodiment of a detailed partial cutaway view of the locking mechanism in the no-fire or locked position and cam lobe in the closed position.

The key 32 is then removed and stored and the weapon is locked. While this embodiment in FIG. 4 shows the second end 36 of the lock plunger 7 visible within slide cavity 8, other embodiments could have slide 1 covering the slide cavity 8 such that the second end 36 would not be visible in this configuration. This would also discourage any potential tampering with the lock plunger 7 should the weapon be obtained by an unauthorized user.

The locking mechanism 28 is difficult to defeat without the key 32. If the weapons is locked and found by an unauthorized user without the key 32, the user will find it difficult to make the weapon operational. The unauthorized user could attempt to jam some tool into the hole 13, FIG. 6, to try to turn the rotation pin 18. This will be difficult as the clearance between the lock shaft 6 and the inside diameter of hole 13 is as small as possible. Unless they can get a good grip on the lock shaft 6, the rotation pin 18 will not turn. This is because the lock plunger 7 first end 34 is seated in the second radius dimple 17, FIG. 4.

While this embodiment shows a hex pattern 12 on the lock shaft 6 and corresponding female hex insert 21 in the key 32, it should be recognized that any types of corresponding lock and key patterns could be used for locking and unlocking the locking mechanism 28.

If in trying to defeat the locking mechanism 28, the lock plunger 7 were attacked, this too would be difficult to defeat. The second end 36 extends into the slide cavity 8, best shown FIG. 4. It is possible that one could attack the second end 36 in attempting to arm the weapon. Second end 36 can be hardened to discourage failure. Even if one were to chisel off the second end 36, the safety lever 4 would still not rotate arming the weapon. As can be seen in FIG. 4, there would still be lock plunger 7 material extending through the housing hole 19 thereby preventing the rotation of the safety lever 4 relative to the lock insert 5. Hence, the weapon still could not be armed.

It will now be apparent to those skilled in the art that other embodiments, improvements, details and uses can be made consistent with the letter and spirit of the foregoing disclosure and within the scope of this patent, which is limited only by the following claims, construed in accordance with the patent law, including the doctrine of equivalents.

I claim:

1. An internal locking mechanism for locking and unlocking a weapon, the weapon having a safety lever and safety shaft, the internal locking mechanism comprising:

the safety shaft having a lock insert housing a rotation pin and a lock plunger, the lock plunger having a first end and a second end, the rotation pin having a lock shaft on one end for engagement with a key and a cam lobe on the opposite end, the cam lobe having a means for moving the lock plunger, said means for moving engaging the first end of the lock plunger, said lock plunger having a return spring for biasing the lock plunger to a position within the lock insert when said first end is acted on by the means for moving the lock plunger, and the means for moving the lock plunger engaging the first end and moving the second end such that the second end protrudes from a housing hole in the safety shaft preventing the safety lever from moving and the weapon from firing.

2. An internal locking mechanism for selectively locking and unlocking a handgun, the locking mechanism having a safety lever and safety shaft, the safety shaft engaging the internal components of the handgun, the internal locking mechanism comprising:

a lock insert housed in the safety shaft, said lock insert containing a rotation pin and a lock plunger, said rotation pin having a lock shaft on one end and a means for moving the lock plunger on a second end, a key for engaging the lock shaft and rotating the rotation pin such that the means for moving the lock plunger engages the first end of the lock plunger causing the second end of the lock plunger to selectively move from a position within the lock insert to a position engaging the handgun where the safety shaft and safety lever cannot rotate.

3. An internal locking mechanism for locking the internal components of a handgun, the internal locking mechanism comprising:

a safety shaft with a safety lever, said safety shaft housing a lock insert, the safety shaft interacting with the handgun internal components such that the rotation of the safety shaft allows handgun operation in one position and prevents handgun operation in a second position, the lock insert containing a rotation pin having a lock shaft on one end and a cam lobe on the opposite end, the cam lobe having a means for moving a lock plunger, the lock plunger having a first end and a second end, the lock plunger moveable from a first position within the lock insert to a second position where the second end of the lock plunger engages the handgun preventing the safety shaft and safety lever from moving.

4. An internal locking mechanism for locking and unlocking a weapon, the weapon having a safety lever and safety shaft, the internal locking mechanism comprising:

the safety shaft having a lock insert housing a centrally located rotation pin and a lock plunger, the rotation pin having a lock shaft on one end and a cam lobe on the opposite end, the cam lobe having a first radius dimple and a second radius dimple, said cam lobe engaging a first end of the lock plunger, said lock plunger having a return spring for biasing the lock plunger within the lock insert when said first end is contained within the first radius dimple of the cam lobe, and said lock plunger having a second end where the rotation of said rotation pin such that the first end rotates on the cam lobe to within the second radius dimple results in said second end of the lock plunger protruding from a housing hole in the safety shaft and prevents the safety lever from rotating and the weapon from firing.

* * * * *